United States Patent [19]

Bobo et al.

[11] 4,198,815

[45] Apr. 22, 1980

[54] CENTRAL INJECTION FUEL CARBURETOR

[75] Inventors: Melvin Bobo; Richard E. Stenger, both of Cincinnati, Ohio

[73] Assignee: General Electric Company, Cincinnati, Ohio

[21] Appl. No.: 823,307

[22] Filed: Aug. 10, 1977

Related U.S. Application Data

[63] Continuation of Ser. No. 644,038, Dec. 24, 1975, abandoned.

[51] Int. Cl.[2] ..... F02C 7/22

[52] U.S. Cl. ..... 60/737; 239/403; 239/406; 60/748

[58] Field of Search ..... 60/39.74 B, 39.74 R; 239/403–406, 414.3, 421, 424.5, 425, 429–431, 433–434.5

[56] References Cited

U.S. PATENT DOCUMENTS

| | | | |
|---|---|---|---|
| 1,462,395 | 7/1923 | Thompson | 239/404 |
| 3,401,883 | 9/1968 | Gebhardt et al. | 239/406 |
| 3,570,242 | 3/1971 | Leonardi et al. | 60/39.74 R |
| 3,589,127 | 6/1971 | Kenworthy et al. | 60/39.74 R |
| 3,703,259 | 11/1972 | Sturgess et al. | 60/39.74 B |
| 3,764,071 | 10/1973 | Carlisle | 60/39.74 B |
| 3,775,039 | 11/1973 | Pillard | 239/406 |
| 3,853,273 | 12/1974 | Bahr et al. | 60/39.74 R |

FOREIGN PATENT DOCUMENTS

| | | | |
|---|---|---|---|
| 894470 | 4/1962 | United Kingdom | 60/39.74 R |
| 1388468 | 3/1975 | United Kingdom | 239/405 |

*Primary Examiner*—Robert E. Garrett

*Attorney, Agent, or Firm*—Dana F. Bigelow; Derek P. Lawrence

[57] ABSTRACT

A low pressure fuel tube delivers fuel to a fuel injector disposed in the central position of the carburetor dome where it is conducted along a plurality of radially extending passages to the periphery of the injector. A high pressure air supply is provided directly to the peripheral fuel flow, in a substantially radial direction, by a disc surrounding the nozzle and having a plurality of radially extending passageways formed therein. A portion of the fuel is blasted directly onto a surrounding venturi surface where it is swirled in a given direction and then exits the downstream end of the venturi where it interacts with a counterrotating pattern of air from the secondary swirler flow to be atomized into a mist. Another portion of the air-blasted fuel from the venturi flows in the axial direction to also enter the combustor as a finely atomized fuel/air mixture.

18 Claims, 10 Drawing Figures

CENTRAL INJECTION FUEL CARBURETOR

The invention herein described was made in the course of or under a contract, or a subcontract thereunder, with the United States Department of the Air Force.

This is a continuation of application Ser. No. 644,038, filed Dec. 24, 1975, now abandoned.

BACKGROUND OF THE INVENTION

This invention relates generally to carburetor devices and, more particularly, to gas turbine engine combustion systems having low pressure central fuel injectors.

Engine manufacturers are constantly striving for a carburetor design which will provide a fuel/air mixture to a continuous-flow combustion chamber for the achievement of complete and efficient combustion of the fuel by minimizing the occurrence of fuel-rich pockets which, upon combustion, may produce carbon or smoke. The attainment of complete combustion is complicated by the ever-present desire to increase engine efficiency and, therefore, combustor pressure inlet temperature and exit temperature. Existing fuel spray atomizer performance deteriorates as combustor pressure is increased due to the requirement for operating over a broad range of conditions. This results in a more nonuniform dispersion of fuel which may cause a nonuniform heating of the combustor shell and hot streaks in the turbine, as well as potential carbon and smoke-producing problems.

The conventional spray atomizers with their high pressure fuel systems are being replaced by low pressure fuel systems having counterrotational primary and secondary swirl vanes which efficiently atomize the fuel by the high shear forces developed at the confluence of the counterrotational airstreams. The most common counterrotational system employs, in the primary stage, an axial swirler where the air enters in an axial direction, is deflected in a somewhat circumferential direction to introduce a swirl to the airflow, and then flows axially downstream within the venturi where it finally mixes and interacts with the air from the counterrotational secondary swirler. One disadvantage of such a system is that, due to the relatively low velocity air introduced at the root of the axial swirler, a deposit of carbon is likely to be formed on the fuel injector, which in turn may affect the flow of fuel and thereby the efficiency of the overall system. Another disadvantage to the axial primary swirler is that of its required axial length which necessitates the extension of, or cutouts on, the combustor cowl which are undesirable due to a lack of structural rigidity and the resultant nonuniform flow path. In addition, an increase in engine length may be required. Further, due to the difference in temperature and thermal response between the outer casing (which determines the location of the fuel injector) and the combustor dome, it is necessary to provide a slip joint to allow for relative thermal growth. In a carburetor system having an axial primary swirler, the location of such a slip joint is likely to cause eccentricity between the primary and secondary airflows to thereby disrupt the resulting swirl flow from the secondary swirler.

Other systems have suggested that a fuel/air mixture be introduced upstream of the swirl vanes, whereupon the fuel becomes subsequently atomized upon shearing of the liquid fuel droplets from the swirl vanes. Such atomizers have been found on occasion to accumulate carbon between the swirl vanes when the inlet airflow and fuel delivered to the atomizers are at relatively high temperature levels. Further, under some combustor operating conditions, fuel decomposition may occur and the resulting formation of carbon deposits within the premixing scroll may tend to restrict the entry of fuel/air mixture into the combustor dome and may possibly lead to fuel spillage out of the scroll inlet and into the air upstream of the dome.

Accordingly, a primary object of this invention is to provide an improved carbureting device for introducing a fuel/air mixture into a combustion chamber for efficient, low emission and low-smoke combustion of the fuel.

Another object of this invention is the provision for the delivery of fuel to the carburetor by a low pressure fuel system which does not allow the formation of carbon on the fuel injector.

Still another object of this invention is the provision for a carburetion device which is relatively short in length and therefore easy to install in a conventional combustor cowl.

Yet another object of this invention is the provision for accommodating the differential expansion and tolerances between elements within the combustor's dome without disrupting the uniform fuel distribution.

A further object of this invention is the provision for a carbureting device which does not allow the backup of fuel outside the combustor.

These objects and other features and advantages become more readily apparent upon reference to the following description when taken in conjunction with the appended drawings.

SUMMARY OF THE INVENTION

Briefly, in accordance with one aspect of the invention, fuel is introduced into the cowl section of the combustor by way of a low pressure fuel delivery tube leading to a central fuel injector having a plurality of ports formed therein for conducting the flow of fuel to the outer periphery of the injector. Surrounding the injector is a disc having a plurality of substantially radially extending passageways formed therein to deliver air in the form of high velocity jets to provide a concentrated blast of air directed at the fuel, which then flows from the periphery of the injector and out into a venturi formed around and downstream of the injector. A portion of the blasted fuel is atomized and passes axially out of the venturi and into the combustor for ignition, and another portion is swirled in one rotational direction within the venturi where it travels axially therealong to exit and counteract with airflow swirling in the opposite rotational direction from a secondary swirler. The resultant atomized mixture then flows downstream into the combustor for ignition.

By another aspect of the invention, the substantially radially extending passageways in the disc are aligned so as to provide an air blast in a direction which is substantially tangential to the periphery of the injector. A portion of these passageways are situated so as to introduce a flow of air directly at the discharge end of the discharge ports, and another portion thereof are aligned so as to direct the air blast flow to points intermediate the discharge ports. The individual jets coalesce into a swirling field which is guided by the venturi. In this way, the fuel which is delivered under low pressure conditions, is finely atomized without allowing the build-up of carbon on the injector tip periphery.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
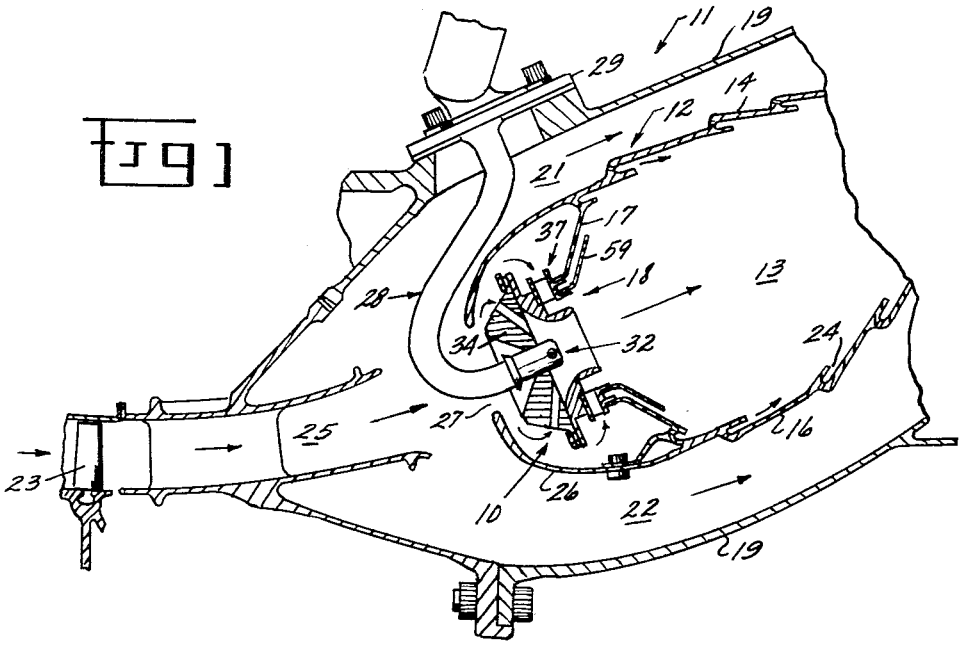
FIG. 1 is an axial cross-sectional view of an exemplary gas turbine combustion apparatus embodying the present invention.

Referring now to the drawings, and particularly to FIG. 1, the invention is shown generally at 10 as applied to a continuous-burning combustion apparatus 11 of the type suitable for use in a gas turbine engine and comprising a hollow body 12 defining a combustion chamber 13 therein. The hollow body 12 is generally annular in form and is comprised of an outer liner 14, an inner liner 16 and a domed end 17. It should be understood, however, that this invention is not limited to such an annular configuration and may be employed with equal effectiveness in combustion-type apparatus of the well-known cylindrical can or cannular type. In the present annular configuration, the domed end 17 of the hollow body 12 is formed with a plurality of circumferentially spaced openings 18, each having disposed therein an improved fuel injection apparatus 10 of the present invention for the delivery of an air/fuel mixture into the combustion chamber 13.

The hollow body 12 may be enclosed by a suitable shell 19, which together with the liners 14 and 16 define passages 21 and 22, respectively, which are adapted to deliver a flow of pressurized air from a suitable source such as a compressor 23 and diffuser 25, into the combustion chamber 13 through suitable apertures or louvers 24 for cooling of the hollow body 12 and dilution of the gaseous products of combustion in a manner well known in the art. The upstream extension 26 of the hollow body 12 is adapted to function as a flow splitter, dividing the pressurized air delivered from the compressor 23 between the passages 21 and 22, and an upstream end opening 27 of the extension 26. The opening 27 fluidly communicates with the improved fuel injection apparatus 10 of the present invention to provide the required air for carburetion.

Delivery of fuel to the fuel injection apparatus 10 is provided by way of a hollow fuel tube 28 which is connected to the outer shell 19 by means of a mounting pad 29. The fuel tube 28, which is curved so as to fit within the opening 27, comprises a piece of hollow tubing having a fuel passageway 31 (FIG. 6) formed therein which supplies liquid fuel to the fuel injector tip 32 for subsequent atomization by the carburetor device of the present invention.

The tip 32 and the associated fuel tube 28 should not be confused with the conventional atomizing nozzles in which fuel is delivered to a combustion chamber as a highly atomized spray. Such conventional atomizing nozzles normally include small passageways of decreasing area by means of which fuel is accelerated, pressurized and thereafter atomized as it expands from the nozzle outlet or throat. In other applications, such atomizing nozzles may include vortex flow paths which are used to accelerate the fuel which is atomized by a process of expansion from the outlet to such flow path. In contrast with this type of atomizing nozzle, Applicants' device includes the use of a low pressure fuel delivery tube 28 which delivers fuel to an injector tip 32, the injector tip having a plurality of ports 33 formed therein for carrying the low pressure fluid stream to the outer periphery of the injector to be carbureted with the air supply in a manner peculiar to the present invention. Generally, a low pressure fuel injection system is defined as one wherein the total exit orifice area (ports) is equal to or greater than the flow area of the fuel supply tube. The specific structure of the fuel tube 28 and fuel injector tip 32 will be more fully described hereinafter.

Referring now to FIGS. 2 through 5, the fuel injector apparatus 10 of the present invention is shown to include, in serial interrelationship, an air blast disc 34, a venturi shroud 36 and a secondary swirler 37. Briefly, carburetion of the fuel from the injector tip 32 for subsequent introduction into the combustor 13, is accomplished by initially directing a plurality of high pressure air jets onto the low pressure fuel stream emanating from the injector ports 33 to partly break up the liquid particles of fuel and create a counterclockwise swirling of the atomized mixture within the venturi shroud 36. A portion of the fuel wets the venturi walls. The swirling mixture, which also has an axial component of velocity, tends to flow out of the downstream lip 39 of the venturi shroud 36 where it interacts with the counterrotational or clockwise rotating swirl of air being delivered by the secondary swirler 37. The interaction between the two airstreams provides a region of high shear forces which acts to finely atomize fuel swirling out of the venturi shroud 36 so that it is ready for ignition within the combustor 13.

Figure 2:
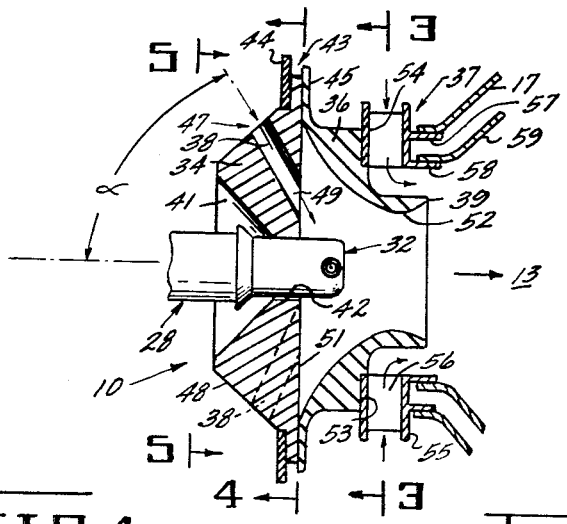
FIG. 2 is an enlarged portion thereof showing the carburetion apparatus of the present invention.
Figure 3:
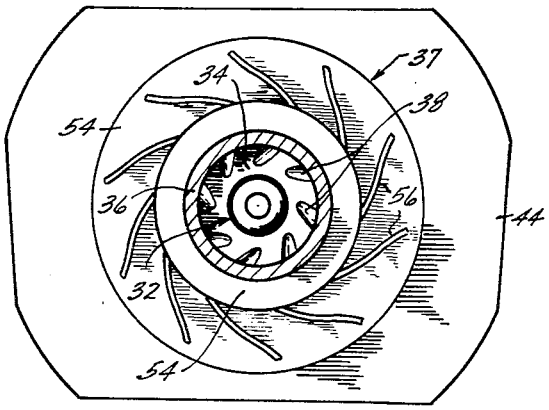
FIG. 3 is a partial cross-sectional view thereof taken along line 3—3 of FIG. 2.
Figure 4:
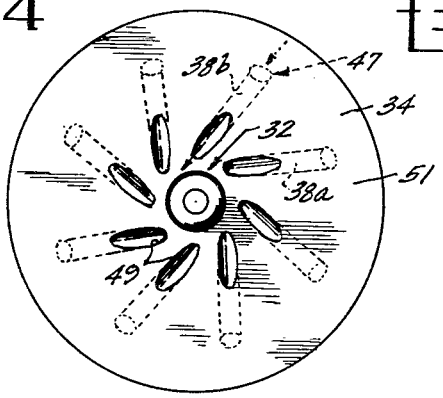
FIG. 4 is a view thereof as seen along line 4—4 of FIG. 2.

As seen in FIGS. 2 and 4, the air blast disc 34 is generally symmetrical about the axis on which the injector tip 32 projects, and includes in its upstream end a frustoconical opening 41 which tapers down to a circular hole 42 for receiving the fuel injector tip 32 therein. Such a tapered opening 41 facilitates the assembly of the fuel injector apparatus by allowing the fuel tube 28 and injector tip 32 assembly to be blindly inserted within the disc from the upstream end thereof. In the assembled position, the injector tip 32 fits loosely within the hole 42 so as to allow relative axial movement as may be caused by mechanical and thermal changes. The air blast disc 34 is held in place by way of a slip joint 43 formed between the venturi flange 45 and an axially spaced bracket 44 attached thereto. Such an annular slip joint 43 provides positive positioning of the disc 34 but allows for relative movement between the disc and the surrounding structure such as may be caused by thermal growth and stacking tolerances.

Formed in the disc 34 is a plurality of passageways 38 for the conduction of high pressure air from the combustor as indicated by the arrows in FIG. 2. The passageways 38 are each defined in part by an inlet opening 47 formed in a bevel face 48 of the disc 34, and on the other end an elongate discharge hole 49 formed in the flap downstream face 51 of the disc. The axes of the passageways 38 form an angle $\alpha$ with the axis of the fuel injector apparatus and, as can be seen in FIG. 2, the angle $\alpha$ is such that the introduction of air into the combustor by way of the passageways 38 is in a generally radial direction as opposed to the axial direction of the prior art. The angle $\alpha$ may vary from 35° to 85° but is preferably designed to provide an optimum distribution of fuel on the venturi and in the free stream. Although the passageways are depicted as being round, other shapes may be used depending on the installation.

Figure 5:
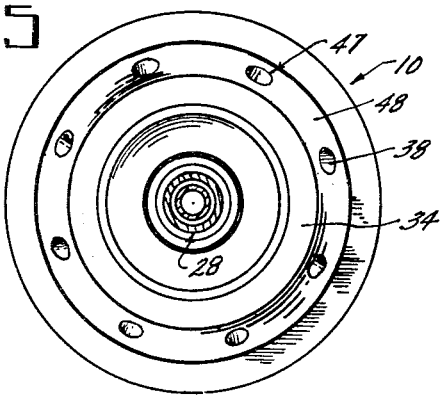
FIG. 5 is a partial cross-sectional view thereof as seen along line 5—5 of FIG. 2.
Figure 8:
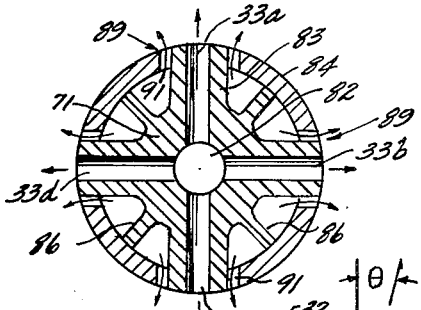
FIG. 8 is a sectional view thereof as seen along lines 8—8 of FIG. 7.

As can be seen in FIGS. 4 and 5, the alignment of the passageways 38 is generally radial in direction, but is slightly offset from the center of the disc so as to be directed onto the outer periphery of the fuel injector tip 32. More specifically, half of the passageways **38*a* are disposed and aligned such that the air flowing from each of the passageways is introduced directly on the discharge end of one of the fuel injector holes 33. The other half of the passageways 38*b*, which are alternately disposed between the aforesaid passageways 38*a*, are disposed and aligned such that the air discharged therefrom is introduced against the periphery of the fuel injector tip 32 at points between the fuel injector holes 33. In other words, assuming an assembly of the nozzle and disc in FIGS. 4 and 8, fuel will be discharged from ports 33 at points 90° apart, including the port 33*a* which is aligned in the upward direction. Referring to FIG. 4, we see that the passageway 38*a* is directed on the fuel injector tip 32 at a point directly at the top periphery thereof to directly coincide with the discharge end of the port 33*a* (FIG. 8). In this way any flow of low pressure fuel that emanates from port 33*a* is immediately blasted by a direct flow of high pressure air to prevent any carbonization of the fuel on the injector tip 32 at that point. Referring now to the adjacent passageway 38*b* in FIG. 4, it will be seen that this passageway is disposed and aligned in a position so as to direct the flow of air at a position intermediate the fuel injector ports 33*a* and 33*d*, respectively, on the periphery of the nozzle. The purpose served by the passageway 38*b* is to change the direction of the fuel which has been blasted by the air from passageway 38*a* so as to further atomize it and to swirl it within the venturi shroud 36. It will thus be seen then that the alignment of the passageways is such that there is an alternate distribution of direct blast (38*a* passageways) and supplementing blasts (38*b* passageways), to jointly provide a concentrated blast of high pressure air to bring about an initial atomization of the low pressure fuel stream without allowing the carbonization of fuel on the periphery of the injector tip 32**. The individual jets of air coalesce and form a swirling vortex which distributes a portion of the fuel on the venturi and another portion into the free stream.

The venturi shroud 36 converges from the flange portion 45 thereof to a point of minimum radius or a throat 52, and then diverges slightly to the downstream lip 39 to define an axial flow path through which the fuel/air mixture may be counterrotationally swirled into the active zone of the secondary swirler 37. The venturi shroud 36 has formed thereon, on the downstream side thereof, a flat face 53 for attachment to the forward wall 54 of the secondary swirler 37 for support therefrom. A uniform annulus is formed between the venturi lip 39 and the secondary swirler exit lip 58.

The secondary swirler 37 includes, in addition to the forward wall 53, an axially spaced aft wall 55 and a plurality of counterrotatable radial flow vanes 56 disposed between the walls 53 and 55 so as to cause the flow of high pressure air in the direction indicated by the arrows in FIG. 2. Support for the secondary swirler 37 is provided by an annular flange 57 extending rearwardly thereof and attached to the domed end 17 by way of welding or the like. The secondary exit lip 58, disposed radially inwardly from the first annular flange 57, has attached thereto a flared trumpet outlet 59 which extends into the combustion chamber 13 as shown in FIGS. 1 and 2.

Turning attention now specifically to the fuel delivery portion of the present invention, the details of the fuel injector tip 32 and the fuel tube 28 are more clearly shown in FIGS. 6 through 10. As will be seen in FIG. 6, the fuel tube 28 comprises an outer tube 61 and an inner tube 62 radially positioned therein by way of a spacer wire 63 so as to provide an insulating space 64 between the outer and inner walls, 61 and 62, respectively. It will be recognized that by the use of the spacer wire 63, a controlled air gap is maintained between the inner and outer tubes without the use of any fixed attachment therebetween. In this way the inner tube 62 is insulated from the high temperatures of the outer tube 61 so that the temperature of the inside wall of the inner tube 62 is maintained below the fuel-gumming temperature. The particular spacing required between the outer and inner walls is dependent on the operational parameters of the engine, and in particular the operating temperatures to which the outer wall 61 is exposed.

It will be recognized that the insulating space 64 is continuous throughout the length of the outer and inner tube combination, and at the downstream end thereof there is an enlargement 66, brought about by a removal of a portion of the outer wall 61, which facilitates the attachment of the fuel tube 28 to the fuel injector tip 32 while maintaining an insulation relationship between the fuel and the outer wall. This is accomplished by way of a protective sleeve 67 interconnecting the tube 28 and the injector tip 32.

The protective sleeve 67 comprises a first cylindrical portion 68 and a second cylindrical portion 69 integrally attached thereto at a position downstream thereof, with the second cylindrical portion having a smaller diameter than that of the first cylindrical portion. The first cylindrical portion 68 is adapted to be placed within the enlargement 66 such that its inner diameter fits over the outer diameter of the inner tube 62 in a close-fit relationship, and that its outer diameter is maintained in spaced relationship from the outer tube 61 so as to preserve the insulating relationship. The second cylindrical portion 69 is adapted to fit within the body 71 of the fuel injector tip 32 such that the outer diameter of the second cylindrical portion is disposed within the inner diameter 72 of the body 71. Positive axial positioning between the protective sleeve 67 and the body 71 is provided by a mating of the respective faces to form the radially extending interface 73 therebetween. In this way, the fuel tube 28 and the fuel injector tip 32 are mated together at 75 and the protective sleeve 67 at its one end engages the inner tube 62, and extends at its other end into the fuel injector inner diameter 72.

It will be recognized that the inner diameter 72 of the body 71 is substantially constant throughout its length, whereas the outer diameter of the second dylindrical portion 69 decreases at a point 74 to provide an annular space 76 between the second cylindrical portion 69 and the body 71. This space 76, which is vented to the fuel flow stream by way of the passage 77, provides an insulating medium between the gas flow stream path 78 and the body 71 which will tend to be heated by way of the relatively hot airstream flow path 79 outside thereof.

Figure 6:
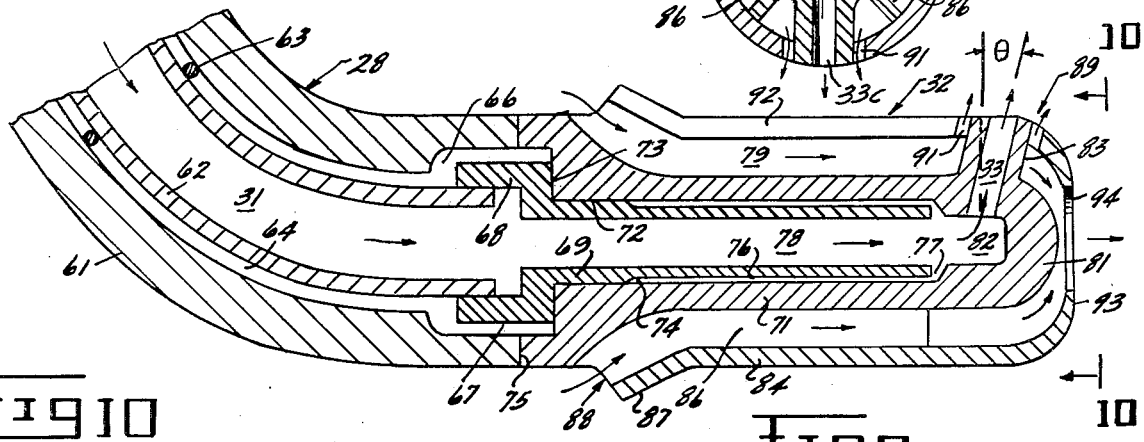
FIG. 6 is a partial axial cross-sectional view of the injector and tube portion of the present invention.
Figure 10:
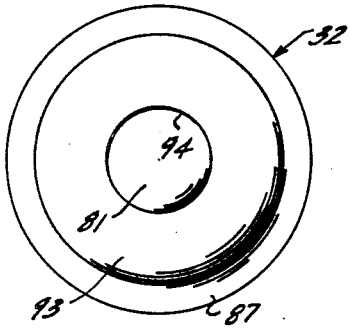
FIG. 10 is an end view of the injector as seen along line 10—10 of FIG. 6.
Figure 7:
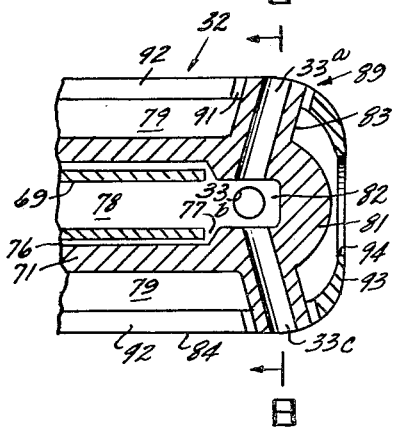
FIG. 7 is a partial cross-sectional view of the tip portion of the injector.

Referring now to FIGS. 6 through 8, the body 71 of the fuel injector tip 32 is seen to be a generally cylindrically shaped element having a closed, generally bulbous downstream end 81. The inner diameter of the body 71 which tightly receives the protective sleeve 67 therein to define the fuel flow path 78, narrows to a small downstream chamber 82, which in turn fluidly communicates with the outer periphery of the injector tip 32 by way of the plurality of ports 33*a* through 33*d* formed in the body, the length of each of the ports 33 being extended by way of a cylindrical exit flow tube 83 extending substantially radially outwardly from the body. The number of flow tubes 83 and associated ports 33 is shown as being four; however, it will be recognized that this number may be increased or decreased to meet the demands or particular operating characteristics desired for a given set of operational parameters. Further, although the axes of the holes 33 are shown as extending at an angle $\theta$ with the radial plane, it will be understood that the angle may be varied so long as the axis is in the generally radial direction. It has been found that for desired performance the magnitude of the angle $\theta$ should preferable not exceed 55°. The area of the throat of the venturi 52 should be so selected as to prevent hot gas recirculation loads to the fuel injector face.

Surrounding the injector body 71 in concentric relationship therewith, is a shroud 84. The shroud 84 is generally cylindrical in form and is secured to and supported by the injector body 71 by a plurality of substantially radially extending ribs 86. Although the number of ribs 86 in the preferred embodiment is shown to be four, it will be recognized that the number may be varied to accommodate mechanical design requirements and preferances. At the rear or upstream end of the shroud 84 is a flared portion 87 which, together with the internal body structure 71, defines the inlet flow passage 88 to the airstream flow path 79. Proximate the downstream end of the shroud 84 there is a plurality of air outlet passages 89 formed therein, the location and size of each of the air outlet passages being such as to surround one of the flow tubes 83 so as to mutually define an annular air passageway 91 therebetween. The purpose of the annular air passageway 91 is to conduct the flow of high pressure air from the airstream flow path 79 to the outer periphery of the shroud 84, and, in so doing, to completely surround the flow of fuel from the flow tube 83 to thereby insulate the gas stream flow from the relatively hot shroud surface which would otherwise cause carbonization of the fuel and a build-up thereof on the shroud surface.

Figure 9:
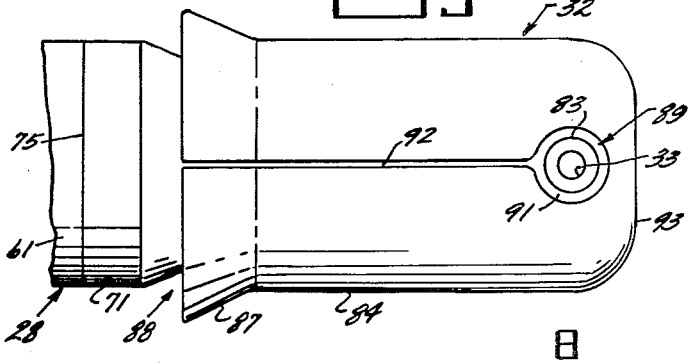
FIG. 9 is a top axial view of the injector as seen in FIG. 6.

As will be seen in FIGS. 7 through 9, the shroud structure 84 has formed therein, in connection with each of the air outlet passages 89, a slit 92, extending from the air outlet passage 89 upstream to the other end thereof. This plurality of slits 92 is provided in recognition of the fact that the temperature of the injector body 71 and the shroud 84 will differ and will therefore cause relative thermal growth therebetween. The slits 92 therefore allow the larger growth of the shroud 84 without causing harmful stresses therein.

At the downstream end of the shroud 84, there is an end wall 93 having an aperture 94 centrally formed therein to conduct the flow of high pressure air from the airstream flow path 79 as indicated by the arrows in FIG. 6. This high pressure airflow tends to form an airspray pattern in the downstream direction so as to further shield the downstream end of the tip from the combustion zone.

In operation, high pressure air is delivered from the compressor 23 through the diffuser 25, to the opening 27, where a portion of the air enters the primary swirler or air blast disc 34 and a portion thereof is supplied to the secondary swirler 37 as shown in FIG. 1. At the same time, a passage of air flows to the frustoconical opening 41 and enters the fuel injector by way of the inlet flow passage 88. From there, the air flows along the flow path 79 and is discharged in a concentric manner with respect to the flow tube 83 so as to insulate the flow tube 83 and the fuel conducted therein from the relatively hot surfaces of the shroud 84 to thereby prevent the build-up of carbon on the flow tube. Further, provision is made upstream of the fuel dispersion point, for the insulation of the fuel flow stream from the hot areas of operation. For example, within the fuel tube 28, an insulating space 64 and an enlargement space 66 is provided between the outer tube 61 and the inner, fluid-carrying tube 62 so as to prevent the heating up of fuel within the fuel passageway 31. The protective sleeve first cylindrical portion 68 is insulated by a surrounding space 66, whereas the downstream second cylindrical portion is isolated by way of an annular passageway 76 which extends to the downstream chamber 82 from which the fuel is discharged to the holes 33 as described hereinbefore.

Returning now to the flow of air to the opening 27, a portion thereof enters the plurality of inlet openings 47 and passes substantially radially along the passageways 38 to be discharged from the elongate discharge hole 49 in a direction shown by FIGS. 2 and 4. As will be seen, the high pressure flow of air is introduced directly on the fuel flow streams as they are discharged from the plurality of ports 33 to cause an immediate dispersion and atomization thereof with a portion of the resulting fuel/air mixture traveling in the axial downstream direction and a greater portion thereof being swirled in a counterclockwise direction within the venturi shroud 36. The swirling mixture then is discharged from the downstream lip 39 of the venturi where it interacts with the airflow stream from the secondary swirler 37, with the secondary flow being in the opposite, or clockwise, direction to further atomize the fuel/air mixture prior to its entering the combustor 13.

What is claimed is:

1. An improved gas turbine engine fuel injection system of the type having a fuel tube leading to an injector, wherein the improvement comprises:

(a) a plurality of fuel injection ports formed in said injector for conducting fuel flow to the outer cylindrical periphery thereof; and (b) air blast means for impinging in a substantially radial direction on the outer periphery of said injector at said plurality of fuel injection ports, said air blast means comprising a disc with upstream and downstream sides and having formed therethrough a plurality of substantially radially aligned orifices providing fluid communication between said upstream and downstream sides.

2. An improved gas turbine engine fuel injector system as set forth in claim 1 wherein said disc has a central aperture formed therein for receiving an injector.

3. An improved gas turbine engine fuel injector system as set forth in claim 1 wherein said air blast means is also adapted to impart an axial velocity to the fuel.

4. An improved gas turbine engine fuel injector system as set forth in claim 1 wherein said flow of air from said air blast means is directed to flow substantially tangentially to the injector at at least one of said ports.

5. An improved gas turbine engine fuel injector system as set forth in claim 1 wherein at least a portion of the flow of air from said air blast means is directed to flow substantially tangentially to the injector at a point intermediate a pair of adjacent said fuel injection ports.

6. An improved gas turbine engine fuel injector system as set forth in claim 2 and including a venturi disposed immediately downstream of said disc for containing said fuel having a circumferential velocity, and for discharging said fuel axially downstream.

7. An improved gas turbine engine fuel injector system as set forth in claim 6 and including a second air blast means downstream of said venturi, said second air blast means adapted to introduce air into said fuel in a direction opposite to the direction of said circumferential velocity.

8. An improved gas turbine engine fuel injector system as set forth in claim 1 wherein the included angle between said flow of air and the axis of said injector is within a range of 35° to 85°.

9. An improved gas turbine engine fuel injector system as set forth in claim 1 wherein said flow of air is comprised of discrete jets of air with each one being directed at one of said plurality of fuel injection ports.

10. An improved gas turbine engine fuel injector system as set forth in claim 1 wherein said plurality of orifices are substantially round in shape.

11. A fuel carbureting device for a gas turbine engine comprising:

(a) an axially disposed injector having an upstream and a downstream end and a plurality of ports formed in the cylindrical periphery, proximate the downstream end thereof;

(b) means for injecting a fuel into said upstream end for discharge from said plurality of holes;

(c) a venturi shroud surrounding said downstream end and having an open downstream end; and (d) a primary air swirler surrounding said injector for impinging in a substantially radial direction a flow of air on said injector periphery, to thereby cause a swirling of the fuel within said shroud in a circumferential and axial direction, said primary air swirler comprising a disc with upstream and downstream sides and having formed therethrough a plurality of substantially radially aligned orifices providing fluid communication between said upstream and downstream sides.

12. A fuel carbureting device as set forth in claim 11 and including a secondary swirler downstream of said shroud for introducing near said shroud downstream end, an air swirl having a circumferential velocity component opposed to that of said primary air swirl.

13. A fuel carbureting device as set forth in claim 11 wherein said disc has a central aperture formed therein for receiving said nozzle.

14. A fuel carbureting device as set forth in claim 11 wherein said primary air swirler also imparts an axial velocity to the fuel.

15. A fuel carbureting device as set forth in claim 11 wherein at least a portion of air from said primary air swirler is directed to flow substantially tangential to the injector at at least one of said ports.

16. A fuel carbureting device as set forth in claim 11 wherein the included angle between said flow of air and the axis of said injector is within a range of 35° and 85°.

17. A fuel carbureting device as set forth in claim 11 wherein said plurality of orifices are substantially round in shape.

18. A fuel carbureting device as set forth in claim 11 wherein said primary air swirler is structurally independent of said injector so as to allow relative axial movement between the two.

* * * * *